US009713407B2

(12) United States Patent
Nelson et al.

(10) Patent No.: US 9,713,407 B2
(45) Date of Patent: Jul. 25, 2017

(54) FAST RELEASE TOILET SEAT ATTACHMENT SYSTEM AND METHOD

(75) Inventors: Michael R. Nelson, Peachtree City, GA (US); Edward Scott Seccuro, McDonough, GA (US); Andrew L. Solinski, Marietta, GA (US)

(73) Assignee: Home Depot Product Authority, LLC, Atlanta, GA (US)

( * ) Notice: Subject to any disclaimer, the term of this patent is extended or adjusted under 35 U.S.C. 154(b) by 415 days.

(21) Appl. No.: 13/437,225

(22) Filed: Apr. 2, 2012

(65) Prior Publication Data

US 2013/0254981 A1 Oct. 3, 2013

(51) Int. Cl.
*A47K 13/12* (2006.01)
*A47K 13/26* (2006.01)

(52) U.S. Cl.
CPC ..... *A47K 13/26* (2013.01); *Y10T 29/49* (2015.01)

(58) Field of Classification Search
CPC ..... A47K 13/12; A47K 13/26
USPC ..... 4/236, 240
See application file for complete search history.

(56) References Cited

U.S. PATENT DOCUMENTS

| | | | | |
|---|---|---|---|---|
| 5,666,672 | A | 9/1997 | Birsel et al. | |
| 5,933,875 | A | 8/1999 | Hulsebus | 4/240 |
| 6,070,295 | A | 6/2000 | Hulsebus | 16/254 |
| 6,101,640 | A | 8/2000 | Brewer et al. | |
| 6,338,167 | B1 | 1/2002 | Baker et al. | |
| 6,826,803 | B2 | 12/2004 | Twomey | 16/387 |
| 7,073,210 | B2 | 7/2006 | Jiang | |
| 7,155,748 | B2 | 1/2007 | Vierkant, III | 4/420 |
| 7,281,276 | B2 | 10/2007 | Vierkant, III | 4/420 |
| 7,340,782 | B2 | 3/2008 | Ortiz | |
| 7,827,626 | B2 * | 11/2010 | Zhou | 4/236 |
| 8,082,603 | B2 | 12/2011 | Leibfried | 4/234 |
| 8,091,154 | B2 | 1/2012 | Allen et al. | |
| 8,205,274 | B2 | 6/2012 | Lin | 4/240 |

(Continued)

FOREIGN PATENT DOCUMENTS

| | | |
|---|---|---|
| CN | 1753636 A | 3/2006 |
| WO | 2006003022 A1 | 3/2006 |

OTHER PUBLICATIONS

Office Action Received in Counterpart Chinese Application 201310113241.2, dated Jun. 24, 2016.

(Continued)

*Primary Examiner* — Christine Skubinna
(74) *Attorney, Agent, or Firm* — Greenberg Traurig, LLP

(57) ABSTRACT

A toilet set can be removably attached to a toilet fixture using a system having an attachment body and a post with laterally mateable portions. The post has a rod portion extendable through a mounting hole of the toilet fixture and a post engagement portion. The attachment body has a pivot portion, a movable closure, and a receiving opening. The post engagement portion is defined by radially oriented features, such as disc or ring-shaped portions of different diameters. A portion of the periphery of the receiving opening has features with contours inversely shaped with respect to the features of the post engagement portion so that the attachment body engagement portion is laterally mateable with the post engagement portion. The closure is movable between a closed position preventing disengagement of the attachment body and the post and an open position enabling disengagement of the attachment body from the post.

26 Claims, 13 Drawing Sheets

(56) References Cited

U.S. PATENT DOCUMENTS

| | | | | |
|---|---|---|---|---|
| 8,281,420 | B2 | 10/2012 | Hand | 4/236 |
| 8,671,468 | B2 | 3/2014 | Hand | 4/236 |
| 8,763,168 | B2 | 7/2014 | Zhou | 4/236 |
| 2004/0064876 | A1 | 4/2004 | Lu | |
| 2007/0061952 | A1 | 3/2007 | Huang | |
| 2008/0083061 | A1 | 4/2008 | Dubiel | |
| 2009/0211004 | A1 | 8/2009 | Daniels et al. | |
| 2009/0276944 | A1 | 11/2009 | Hand | 4/240 |
| 2011/0030134 | A1 | 2/2011 | Dubiel | |
| 2011/0067170 | A1* | 3/2011 | Greenspon | 4/236 |
| 2012/0011646 | A1* | 1/2012 | Dundas et al. | 4/420 |
| 2012/0240318 | A1* | 9/2012 | Sims | 4/236 |
| 2013/0067647 | A1 | 3/2013 | Stelter | 4/240 |
| 2013/0340154 | A1* | 12/2013 | Hand et al. | 4/240 |

OTHER PUBLICATIONS

Chinese office action received application No. 201310113241.2, dated Feb. 20, 2017, eleven pages.
Mexican office action received in related patent application No. MX/a/2013/003727, dated Mar. 7, 2017, six pages.

* cited by examiner

FAST RELEASE TOILET SEAT ATTACHMENT SYSTEM AND METHOD

BACKGROUND

A variety of systems that facilitate temporary detachment of a toilet seat from a toilet fixture to facilitate cleaning are known. The time-honored attachment system, which comprises two threaded bolts extending from the toilet seat hinge assembly through holes in the upper rim portion of the toilet fixture, is inconvenient because nuts must be removed from the ends of the threaded bolts below the lower rim portion to detach the toilet seat. The known systems that facilitate temporary detachment suffer from various deficiencies. Some require a person to manipulate multiple parts to detach the toilet seat. Others do not retain the toilet seat with sufficient strength to prevent inadvertent detachment. Still others are difficult or uneconomical to manufacture.

It would be desirable to provide a system that facilitates temporary detachment of a toilet seat from a toilet fixture that is easier to use, less prone to inadvertent detachment than known systems, and more economical to manufacture.

SUMMARY

Embodiments of the present invention relate to a system and method for removably attaching a toilet seat to a toilet fixture. The attachment system comprises a post that is attachable to the toilet fixture and an attachment body that engages the post and is attachable to the toilet seat.

In an exemplary embodiment, the post has a post axis, a rod portion extendable through a mounting hole of the toilet fixture, and a post engagement portion oriented radially to the post axis. The attachment body has a pivot portion with a pivot axis, a receiving opening with a receiving opening axis perpendicular to the pivot axis, and a movable closure. A periphery of the receiving opening has an attachment body engagement portion oriented radially to the receiving opening axis and mateable with the post engagement portion from a lateral direction with respect to the receiving opening axis and the post axis when the post engagement portion is received in the receiving opening. The closure is movable between a closed position in which the attachment body engagement portion and the post engagement portion are prevented from disengaging each other and an open position in which the attachment body engagement portion and the post engagement portion can be disengaged from each other.

In the exemplary embodiment, a toilet seat assembly comprising a toilet seat hingedly coupled to the pivot portion of the attachment body can be attached to a toilet fixture in the following manner. The rod portion of the post is first extended through a mounting hole of the toilet fixture while a post engagement portion of the post remains above (e.g., resting on) the surface of the toilet fixture. The rod portion is then secured in the mounting hole of the toilet fixture. The post engagement portion of the post is guided into the receiving opening while placing the toilet seat on top of the toilet fixture. The toilet seat assembly can then be moved laterally with respect to the receiving opening axis until an attachment body engagement portion mates with the post engagement portion. After the attachment body engagement portion mates with the post engagement portion, the closure can be moved from the open position to the closed position.

Other systems, methods, features, and advantages of the invention will be or become apparent to one of skill in the art to which the invention relates upon examination of the following figures and detailed description. All such additional systems, methods, features, and advantages are encompassed by this description and the accompanying claims.

BRIEF DESCRIPTION OF THE FIGURES

The invention can be better understood with reference to the following figures. The elements shown in the figures are not necessarily to scale, emphasis instead being placed upon clearly illustrating the principles of the invention. Also, in the figures like reference numerals designate corresponding elements throughout the different views.

DETAILED DESCRIPTION

Figure 1:
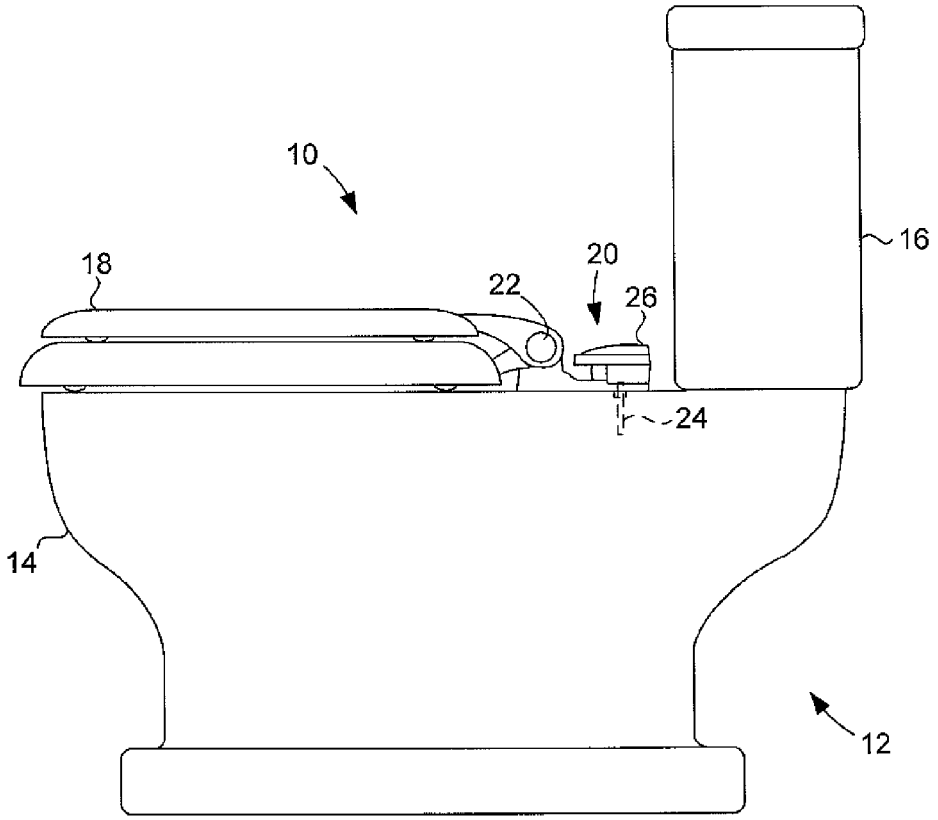
FIG. 1 is a side elevation view of a toilet seat assembly removably attached to a toilet fixture, in accordance with an exemplary embodiment of the invention.

As illustrated in FIG. 1, in an illustrative or exemplary embodiment of the invention, a toilet seat assembly 10 can be attached in a removable manner to a toilet fixture 12. Toilet fixture 12 is of a conventional type with which persons skilled in the art are familiar, defined by the combination of a bowl 14 and a tank 16 (commonly made of porcelain or a similar ceramic material, though other materials are known) and is therefore not described herein in further detail. Toilet seat assembly 10 comprises a seat-and-lid assembly 18 and a pair of identical attachment bodies 26. But for being connected by a hinge 22 to attachment body 26, seat-and-lid assembly 18 is of a conventional type with which persons skilled in the art are familiar and is therefore not described herein. For purposes of brevity, toilet seat assembly 10 or other such assembly that includes a seat, hinge, and means for hingedly attaching the seat to a toilet fixture may also be referred to simply as a "toilet seat."

Figure 2:
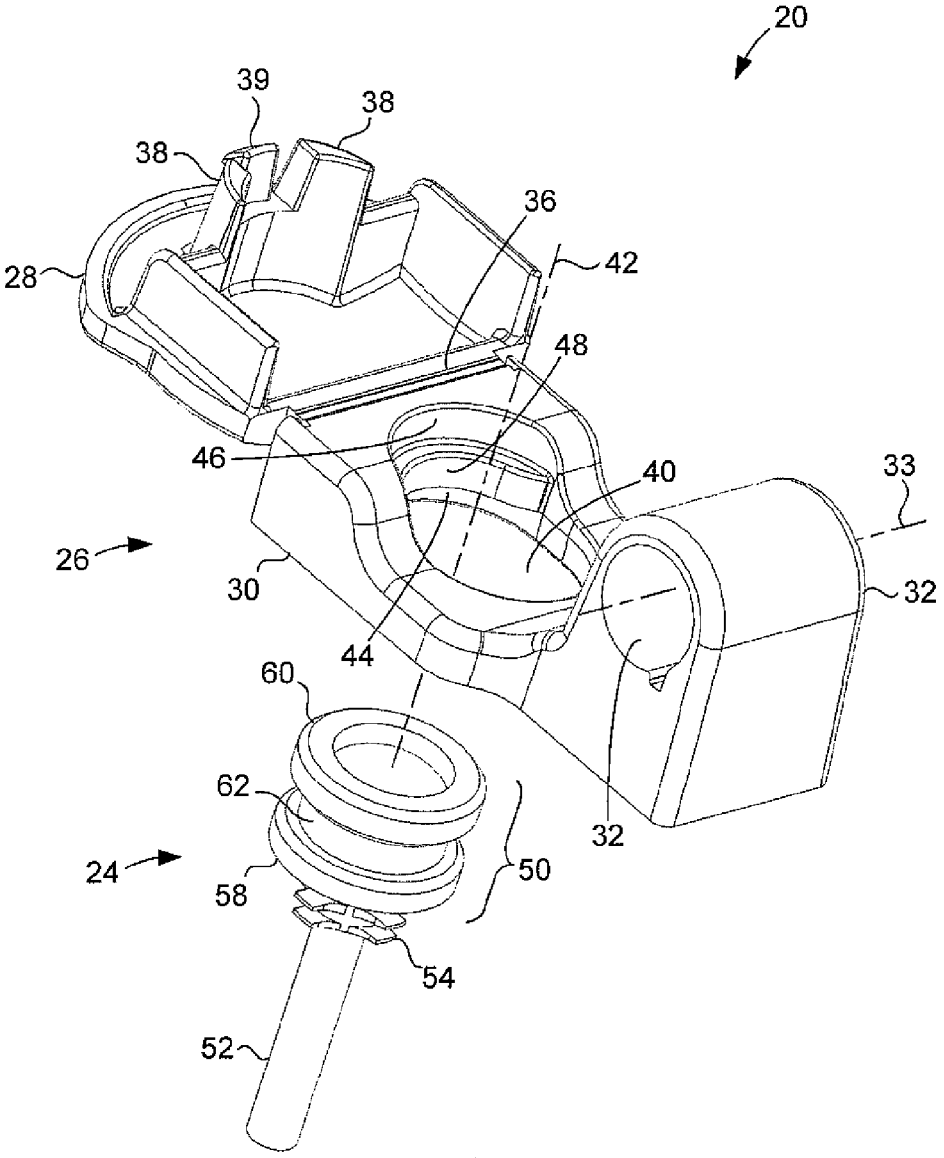
FIG. 2 is a perspective view of an attachment body and a post of the toilet seat assembly of FIG. 1.

As illustrated in FIG. 2, each of two attachment systems 20 comprises a post 24 and one of attachment bodies 26. In the exemplary embodiment, attachment body 26 is unitarily formed of a single piece of molded plastic. Such unitary or one-piece construction is economical to manufacture and convenient to use. However, in other embodiments such an attachment body can comprise more than one part.

Attachment body 26 comprises a movable closure 28, a base portion 30, and a pivot portion 32 having a pivot axis 33. In the exemplary embodiment pivot portion 32 comprises a block-like member having a bore 34 therethrough for receiving a hinge pin (not shown) of hinge 22 (FIG. 1) that is rotatable within bore 34. However, in other embodiments pivot portion 32 can have any other suitable structure. For example, in another embodiment (not shown), such a pivot portion can comprise an inverse arrangement from that of the illustrated embodiment, in which hinge pins extending from the pivot portion of the attachment body in fixed relation thereto are rotatable within bores in another portion of the hinge.

Closure 28 is shown in the open position shown in FIG. 2 and is movable to a closed position as described below. Closure 28 rotates or swings in a hinged manner on a living hinge 36 formed in the plastic joining closure 28 to base portion 30. Closure 32 has curved projections 38 and a latching tab 39 extending from it.

Attachment body 26 has a receiving opening 40 extending through base portion 30 between upper and lower sides of base portion 30. A direction normal to receiving opening 40 can be defined by a receiving opening axis 42. The periphery of receiving opening 40 has a surface contour or otherwise has features that project inwardly from the walls of receiving opening 40 a substantially radial direction with respect to receiving opening axis 42 in a manner that defines an attachment body engagement portion. (The radial direction is also referred to herein as a lateral direction in the context of relative movement of elements.) In the exemplary embodiment, the attachment body engagement portion is defined by three arc-shaped regions 44, 46 and 48 that project (substantially radially) inwardly from the periphery of receiving opening 40 to different extents. Arc-shaped region 48, which is disposed between arc-shaped regions 44 and 46, projects inwardly to a greater extent than arc-shaped regions 44 and 46. Although in the exemplary embodiment the surface contour that defines the attachment body engagement portion is defined by arc-shaped regions 44, 46 and 46, in other embodiments the surface contour that defines the attachment body engagement portion can be defined by any other suitable features that project inwardly from the periphery of receiving opening 40.

Figure 3:
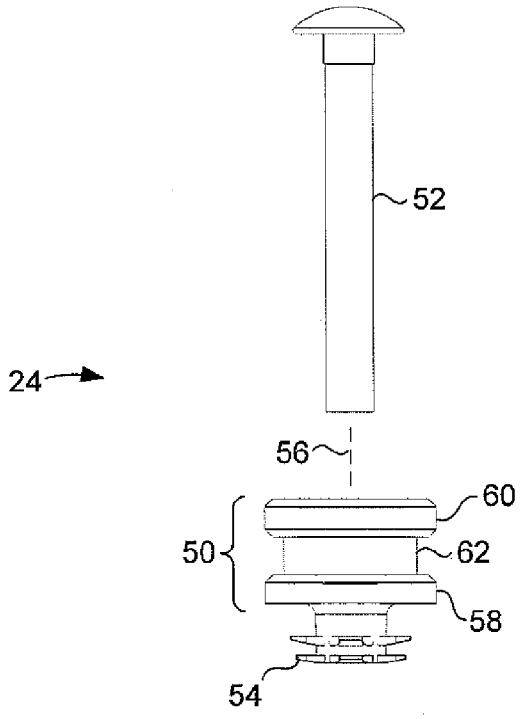
FIG. 3 is an exploded view of a post of the toilet seat assembly of FIG. 1.

Post 24 comprises a post engagement portion 50 and a threaded rod portion 52. Threaded rod portion 52 can be of a type commonly referred to as a carriage bolt and extends through a bore in post engagement portion 50 as shown in FIG. 3. Threaded rod portion 52 similarly extends through an elastomeric bushing 54. Post engagement portion 50 has a surface contour or otherwise has features that project outwardly or in a radial direction with respect to a longitudinal axis 56 in a manner that defines a post engagement portion. In the exemplary embodiment, the post engagement portion is a barrel-shaped member defined by a lower barrel portion 58, an upper barrel portion 60, and a middle barrel portion 62. Lower and upper barrel portions 58 and 60 have diameters that are greater than the diameter of middle barrel portion 62, which is disposed between lower and upper barrel portions 58 and 60. Note that the contour of post engagement portion 50 that is defined by barrel portions 58-62 inversely matches the contour of the attachment body engagement portion that is defined by arc-shaped regions 44-48. The matching contours of the attachment body engagement portion and post engagement portion 50 promote the mating of the attachment body engagement portion and post engagement portion 50 described below.

Figure 4:
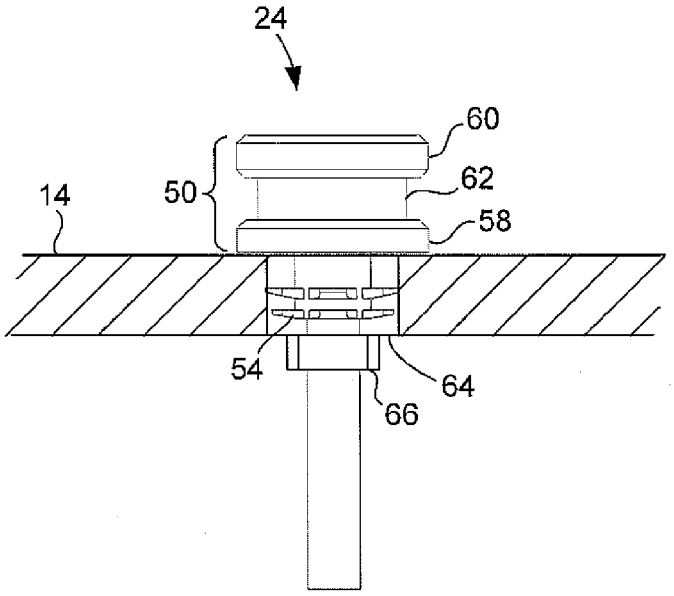
FIG. 4 is a sectional view of the rim of the toilet fixture of FIG. 1, showing the post seated in a hole therein.
Figure 5:
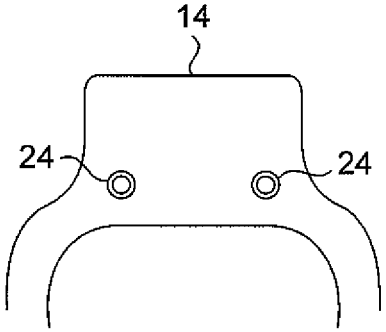
FIG. 5 is a top plan view of a portion of the top of the bowl of the toilet fixture of FIG. 1.

As illustrated in FIGS. 4 and 5, a method of attaching toilet seat assembly 10 to toilet fixture 12 (FIG. 1) can begin with extending an end of threaded rod portion 52 of post 24 through a mounting hole 64 in the rim of bowl 14 until post engagement portion 50 rests on the surface of the rim. A nut 66 can then be threaded onto the end of threaded rod portion 52 below the rim and tightened to secure post 24.

In positioning post 24 in the above-described manner, elastomeric bushing 54 is inserted into mounting hole 64. The interior walls of mounting hole 64 are typically somewhat irregularly shaped or rough rather than smoothly cylindrical because they are typically molded into the porcelain in an imprecise manner. As elastomeric bushing 54 has a diameter greater than that of mounting hole 64, elastomeric bushing 54 is resiliently compressed by the interior walls of mounting hole 64 and, accordingly, exerts a resilient expansion force. By exerting a resilient expansion force against the irregularly shaped walls of mounting hole 64, elastomeric bushing 54 can inhibit movement of post 24 within mounting hole 64.

Figure 6:
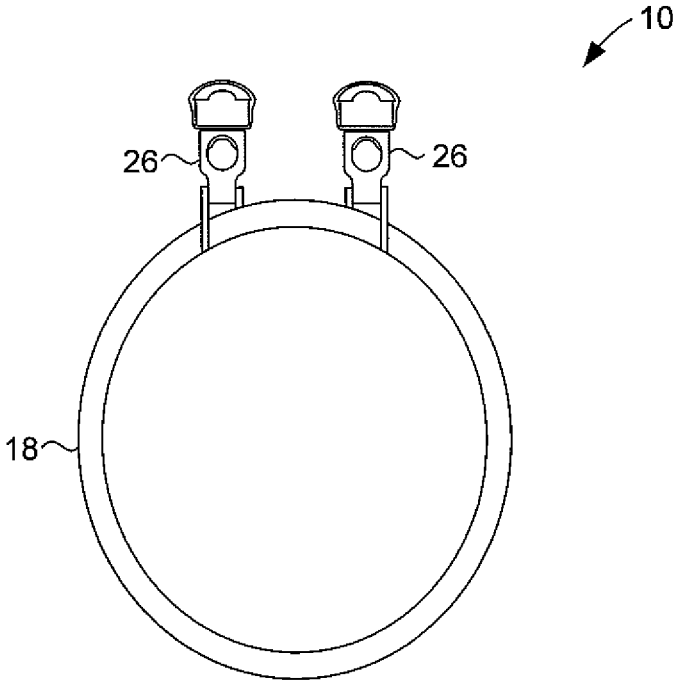
FIG. 6 is a top plan view of the toilet seat assembly of FIG. 1.
Figure 7:
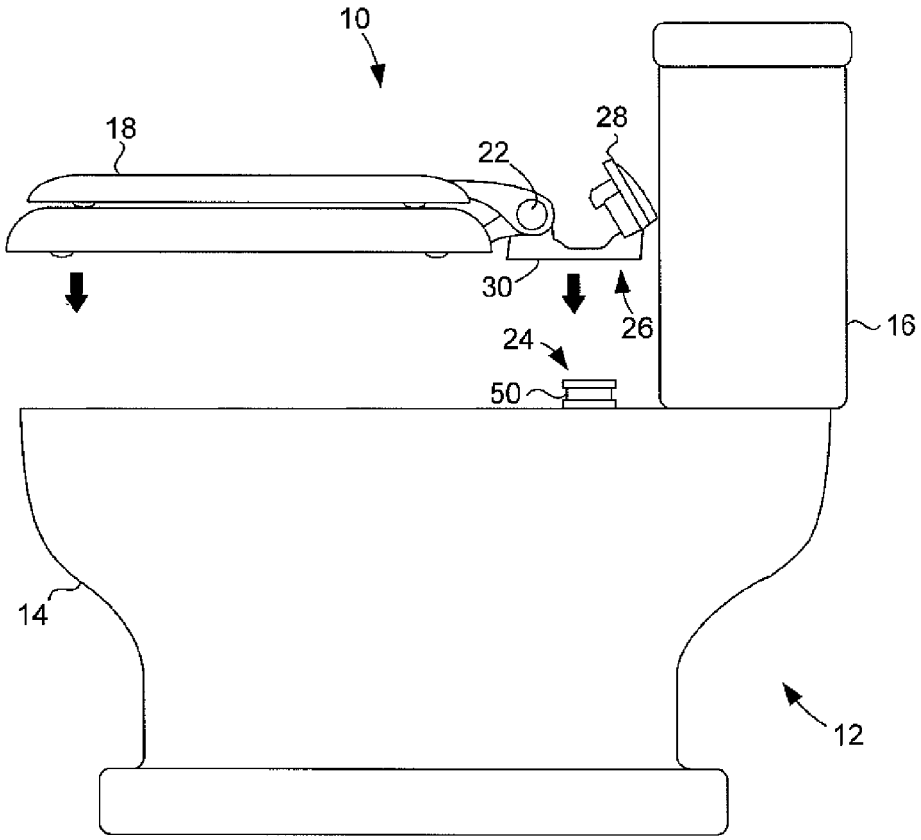
FIG. 7 is similar to FIG. 1, showing the toilet seat assembly being lowered onto the toilet fixture.
Figure 8:
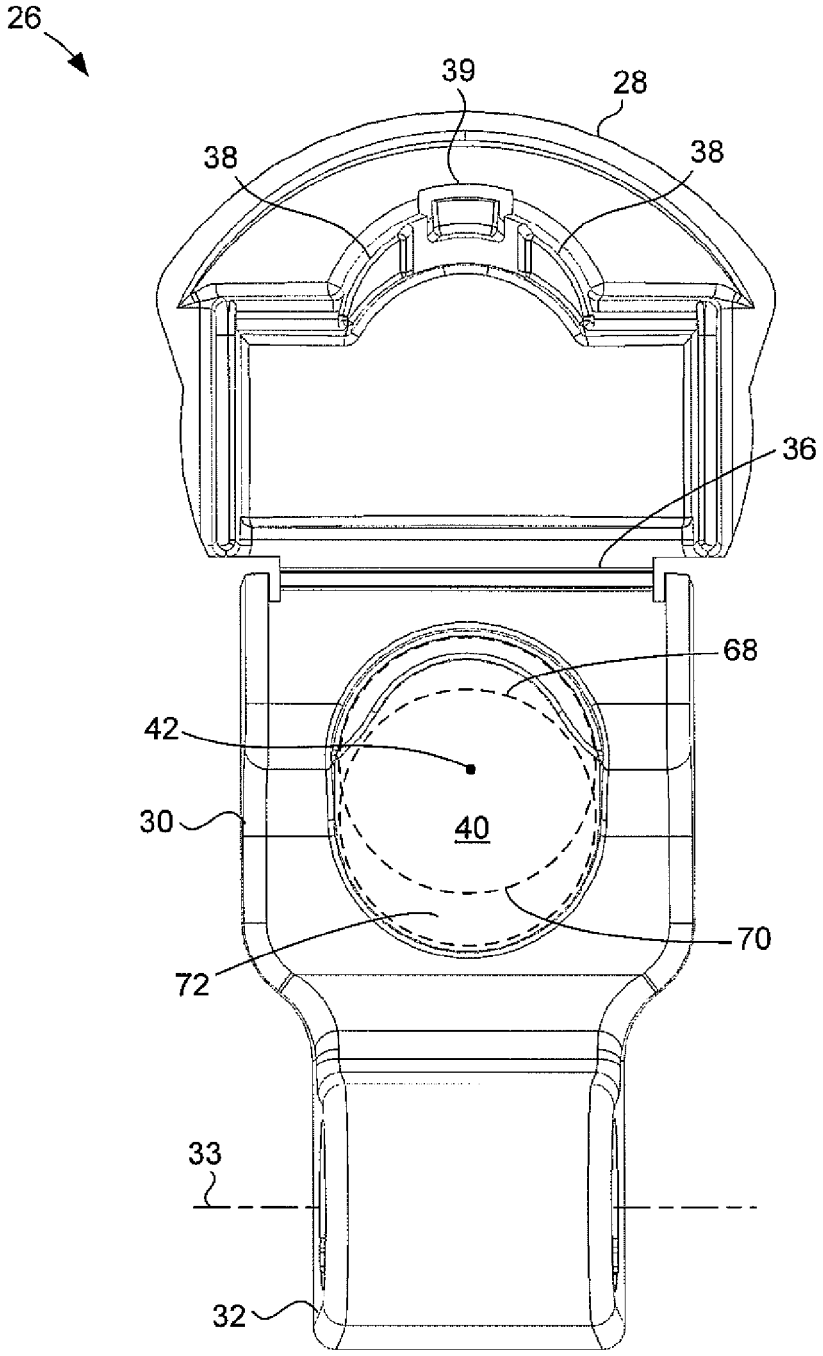
FIG. 8 is similar to FIG. 1, showing the toilet seat assembly being moved in a lateral direction to engage mating features of the attachment bodies and posts.

As illustrated in FIG. 7, in another step of the attachment method, toilet seat assembly 10 (FIG. 6), comprising seat-and-lid assembly 18 and the pair of attachment bodies 26, can be positioned over toilet bowl 14. Then, toilet seat assembly 10 can be lowered (in the direction of the arrows in FIG. 7) on top of toilet bowl 14 until post engagement portions 50, which rest on the rim of toilet bowl 14, are received within the respective receiving openings 40. As illustrated in FIG. 8, a sub-region 68 or receiving region within receiving opening 40 has a diameter large enough that post engagement portion 50 can be received within sub-region 68 without interference. That is, receiving opening 50 has no lateral dimension (i.e., a dimension extending in a direction that is radial or perpendicular to receiving opening axis 42) smaller than a maximum radial dimension of post engagement portion 50.

Figure 9:
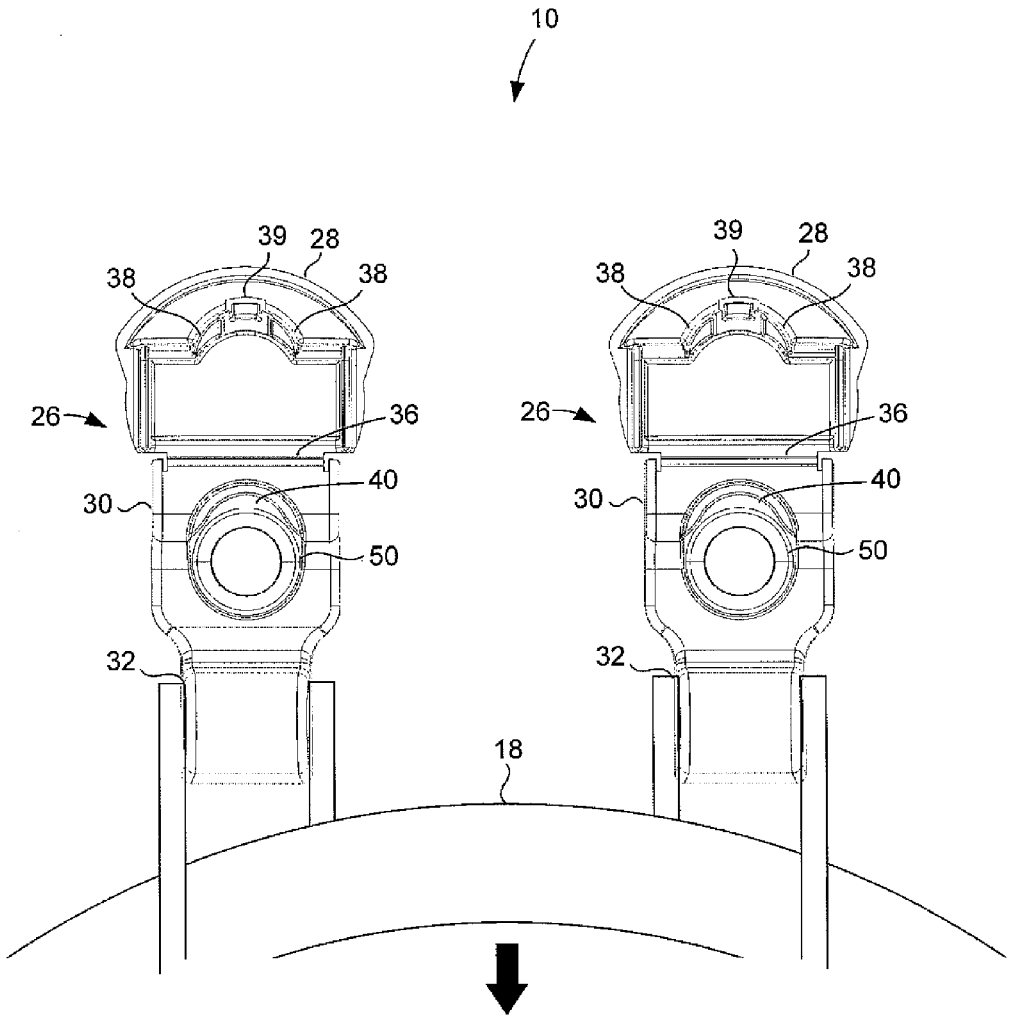
FIG. 9 is a top plan view, showing the toilet seat assembly being moved in a lateral direction to engage mating features of the attachment bodies and posts.
Figure 10:
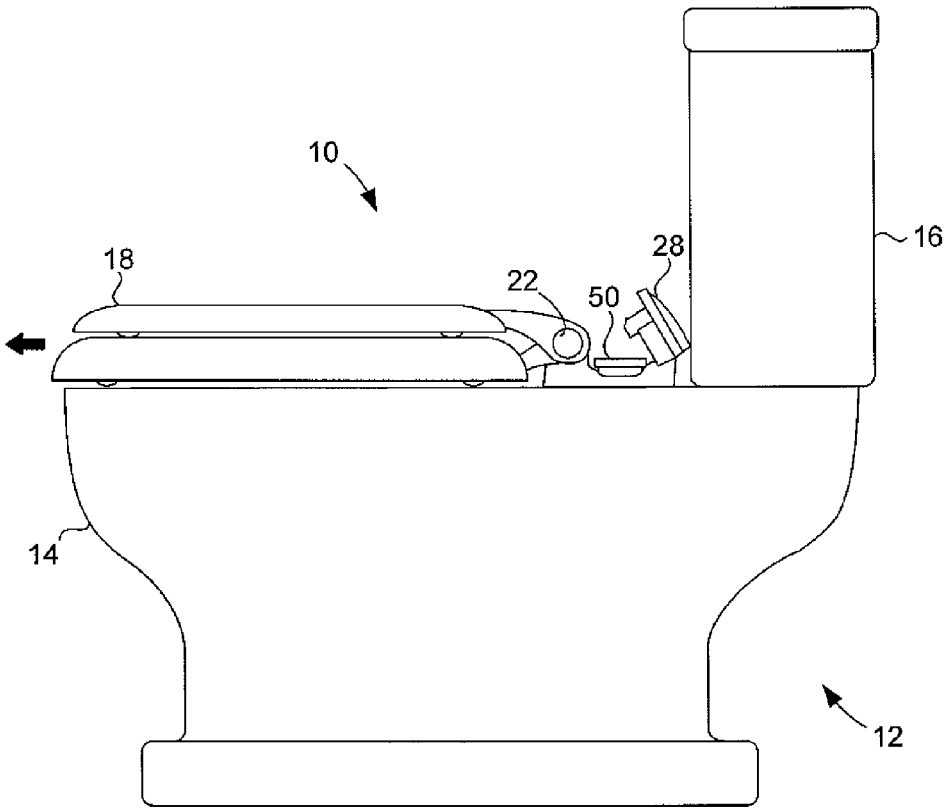
FIG. 10 is a top plan view of one of the attachment bodies of the toilet seat assembly of FIG. 1.
Figure 11:
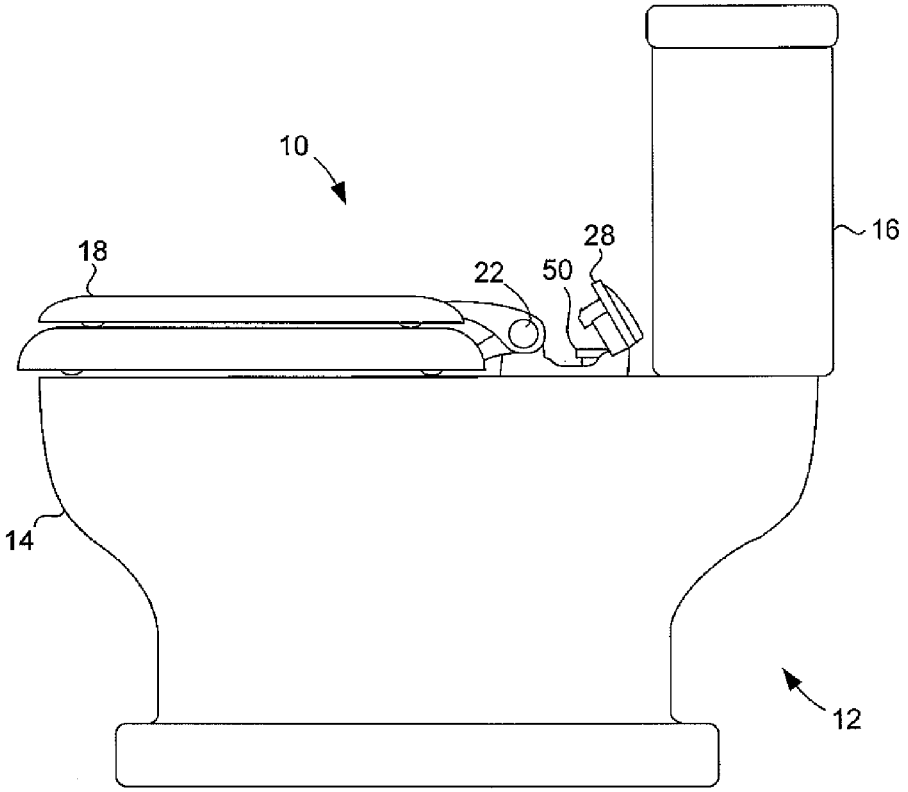
FIG. 11 is a side elevation view similar to FIG. 1, showing the toilet seat assembly after being moved in a lateral direction to engage mating features of the attachment bodies and posts but before the closure is moved to the closed position.
Figure 12:
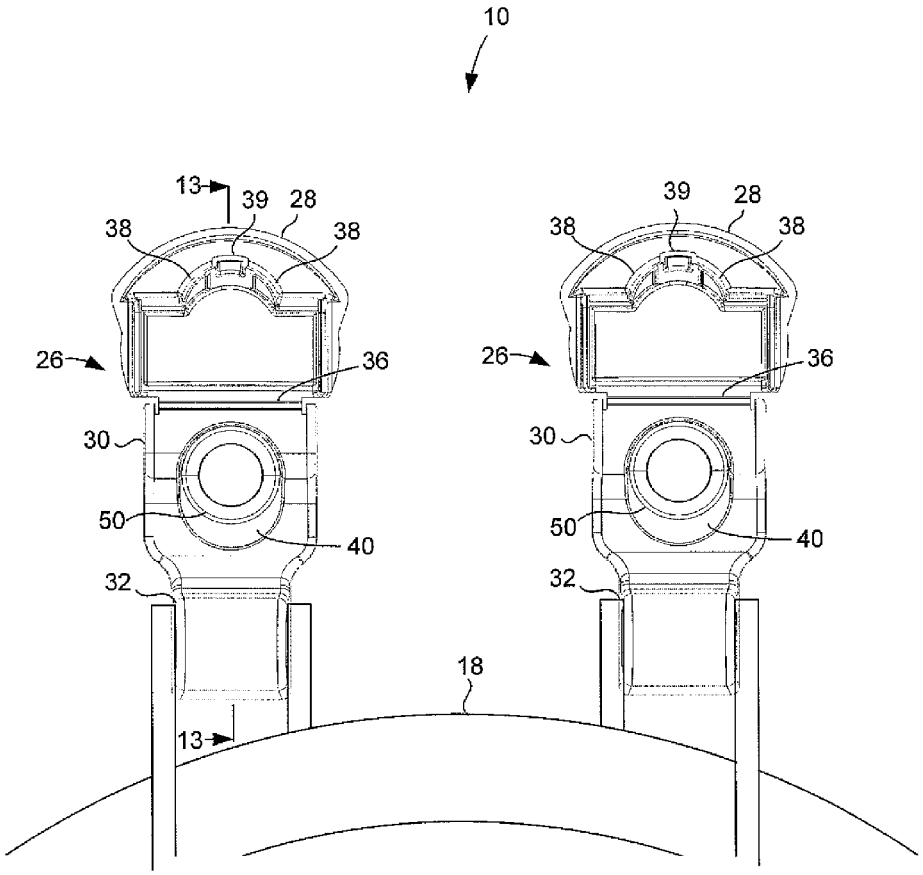
FIG. 12 is similar to FIG. 10, showing after being moved in a lateral direction to engage mating features of the attachment bodies and posts but before the closure is moved to the closed position.

Once post engagement portions 50 are received in the above-described manner within the respective receiving openings 40, pulling or otherwise moving toilet seat assembly 10 in the direction of the arrows shown in FIGS. 9 and 10 mates the attachment body engagement portion of receiving opening 40 with post engagement portion 50. Attachment body 20 and post 24 are shown in this mated position in FIGS. 11-13.

Figure 13:
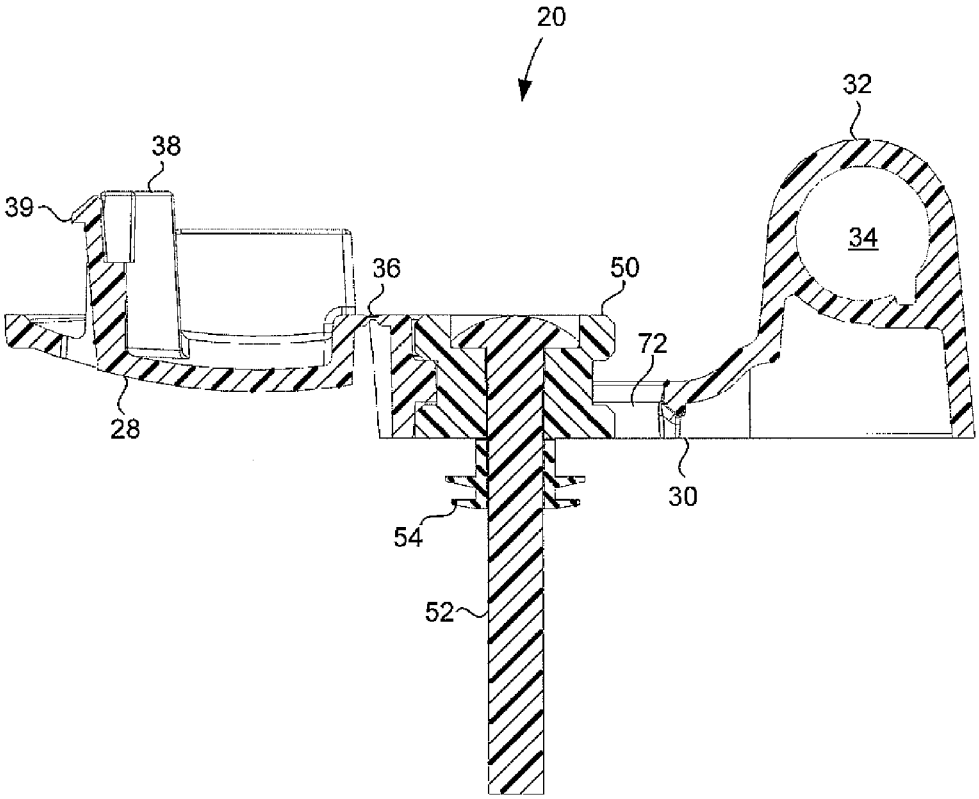
FIG. 13 is a sectional view taken on line 13-13 of FIG. 12.

With reference to FIG. 13, in this mated position arc-shaped region 48 of the attachment body engagement portion nests between lower and upper barrel portions 58 and 60 of post engagement portion 50 and abuts middle barrel portion 62, while lower and upper barrel portions 58 and 60 respectively abut arc-shaped regions 44 and 46. Also, in this mated position post engagement portion 50 occupies a second sub-region 70 (FIG. 8) within receiving opening 40, having previously occupied the first sub-region 68 before mating occurred (i.e., before toilet seat assembly 10 was moved). Note that the first and second sub-regions 68 and 70 overlap. The portion of receiving opening 40 vacated by post engagement portion 50 as a result of the mating defines a third sub-region 72. Third sub-region 72 can alternatively be defined as receiving opening 40 minus second sub-region 70. Although in the exemplary embodiment sub-regions 68 and 70 have circular shapes because receiving opening 40 has a shape resembling a rectangle with semicircular ends, in other embodiments a receiving opening and its sub-regions that are defined by the movement of the post engagement portion can have any other suitable shapes.

Figure 14:
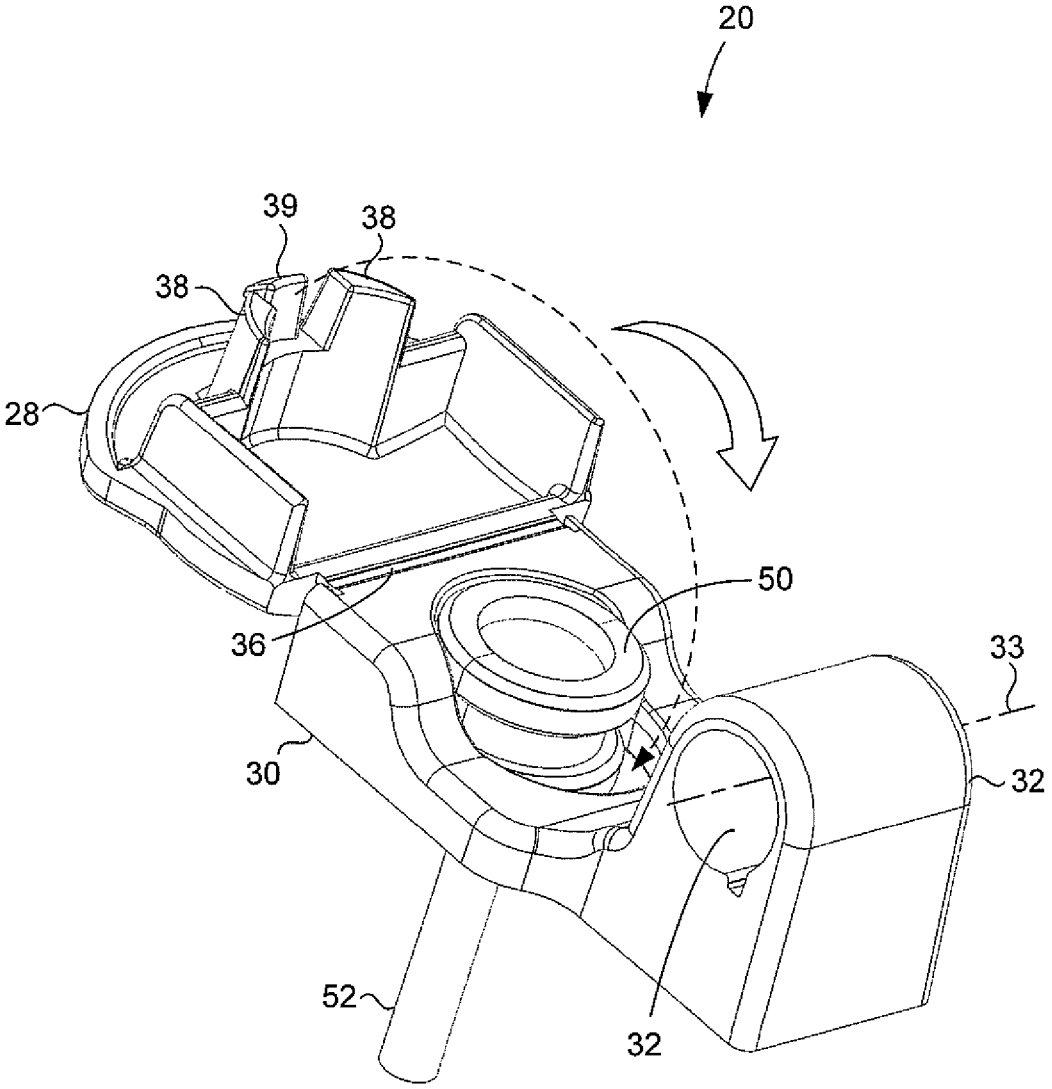
FIG. 14 is a perspective view of one of the attachment bodies of the toilet set assembly of FIG. 1, indicating the movement of the closure to the closed position.
Figure 15:
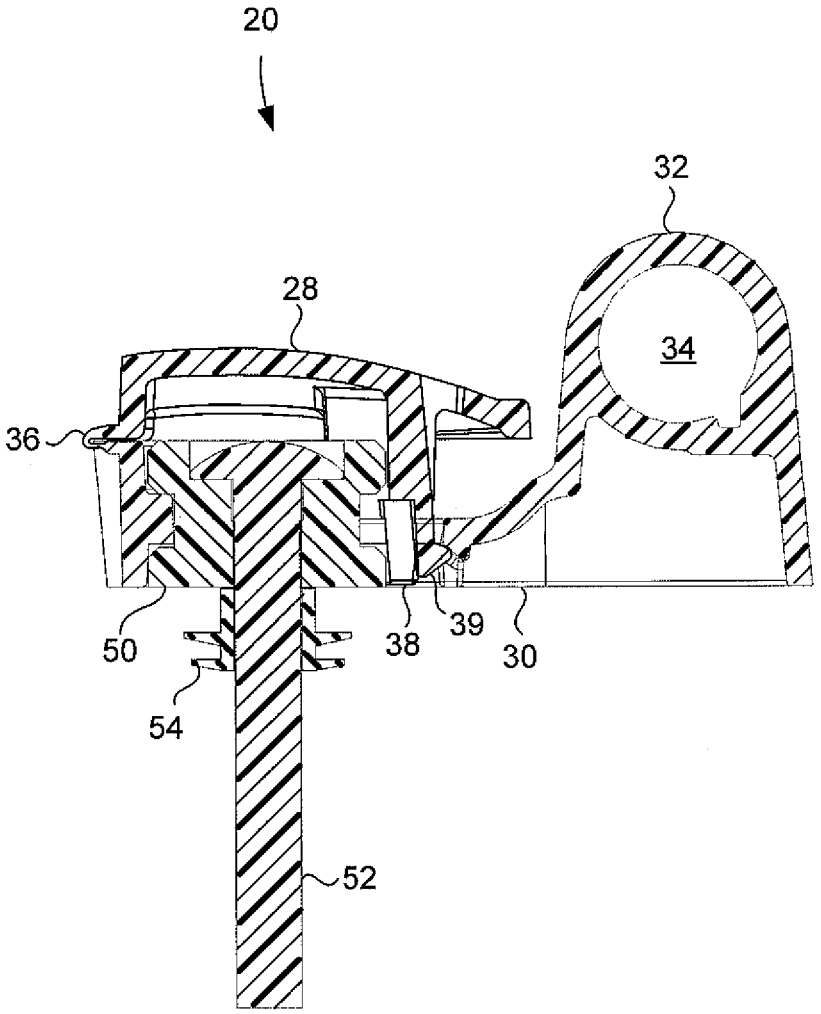
FIG. 15 is a sectional view similar to FIG. 13, showing the closure in the closed position.

As illustrated in FIGS. 14 and 15, to complete the method of attaching toilet seat assembly 10 to toilet fixture 12, closure 28 can be swung closed in the direction indicated by the arrow in FIG. 14. Closure 28 swings closed on hinge 36 to cap post engagement portion 50. The broken line in FIG. 14 indicates the arcuate path that latching tab 39 follows as closure 28 is swung to the closed position. As latching tab 39 reaches the end of the arcuate path (FIG. 14), it enters the above-referenced third sub-region 72 defined by the void or space remaining between post engagement portion 50 and the periphery of receiving opening 40. Curved projections 38 also enter this void or space that defines sub-region 72, and by occupying the space thereby block lateral movement of post engagement portion 50 relative to attachment body 26. Latching tab 39 has a hooked tip that latches the underside of base 30 and retains closure 28 in the closed position.

While one or more embodiments of the invention have been described as illustrative of or examples of the invention, it will be apparent to those of ordinary skill in the art that other embodiments are possible that are within the scope of the invention. Accordingly, the scope of the invention is not to be limited by such embodiments but rather is determined by the appended claims.

What is claimed is:

1. A system comprising:

a post having:

a post axis;

a rod portion extendable through a mounting hole of a toilet fixture;

a post head attached to the rod portion; and a post engagement portion distinct from the post head and from the rod portion and oriented radially to the post axis, the post engagement portion having a passageway in which a portion of the rod portion can be positioned, the post engagement portion also having a recess in communication with the passageway and in which the post head can be positioned, the post engagement portion comprising a barrel portion having a plurality of different diameters defining a contour of the post engagement portion;

an attachment body having:

a pivot portion with a pivot axis;

a receiving opening having a receiving opening axis perpendicular to the pivot axis, a periphery of the receiving opening having a first height and an attachment body engagement portion oriented radially relative to the receiving opening axis and mateable with the post engagement portion from a lateral direction with respect to the receiving opening axis and the post axis when the post engagement portion is received in the receiving opening, the attachment body engagement portion having a contour that is complementary to the contour of the post engagement portion;

a base portion having a bottom surface; and a movable closure hingedly coupled to the base portion and having a tab portion, the tab portion including a latching tab and a curved projection having a contour that is complementary to the contour of the post engagement portion, the closure movable between a closed position preventing disengagement of the attachment body engagement portion and the post engagement portion and an open position enabling disengagement of the attachment body engagement portion from the post engagement portion; and an elastomeric bushing distinct from the attachment body and having a top, the elastomeric bushing coupled to the post such that, when the post head is positioned in the recess of the post engagement portion, the top of the elastomeric bushing is positioned below the bottom surface of the base portion;

wherein, in the closed position, the latching tab of the tab portion contacts the base portion to retain the movable closure in the closed position, and the tab portion is separated from the post head by the post engagement portion and positioned between the pivot portion and the post engagement portion; and wherein, in the closed position, the movable closure is positioned above a covered portion of the attachment body located between the pivot portion and the post engagement portion, the first height being greater than any height of the covered portion, and the covered portion is positioned below a concave bottom surface of the movable closure.

2. The system of claim 1, wherein the barrel portion has an upper barrel portion with an upper barrel portion diameter, a lower barrel portion with a lower barrel portion diameter, and a middle barrel portion with a middle barrel portion diameter between the upper and lower barrel portions, wherein the middle barrel portion diameter is less than the upper and lower barrel portion diameters.

3. The system of claim 1, wherein a receiving region of the receiving opening has no lateral dimension smaller than a maximum radial dimension of the post engagement portion to enable receiving the post engagement portion in the receiving opening from an axial direction with respect to the receiving opening axis.

4. The system of claim 3, wherein when the movable closure is in the closed position a portion of the movable closure occupies space within the receiving region between the post and the periphery of the receiving opening to prevent lateral movement of the post and the attachment body relative to one another.

5. The system of claim 3, wherein when the attachment body engagement portion is not mated with the post engagement portion the post engagement portion occupies a first sub-region of the receiving region, and when the attachment body engagement portion is mated with the post engagement portion the post engagement portion occupies a second sub-region wherein the first sub-region and second sub-region overlap each other.

6. The system of claim 5, wherein a third sub-region of the receiving region is defined by the receiving region minus the second sub-region, and the tab portion of the movable closure is disposed within the third sub-region when the movable closure is in the closed position.

7. The system of claim 6, wherein the movable closure is hingedly movable between the open position and the closed position, and the tab portion of the movable closure is movable along an arcuate path into the third sub-region when the movable closure moves from the open position to the closed position.

8. The system of claim 1, wherein the movable closure is hingedly movable between the open position and the closed position.

9. The system of claim 8, wherein in the closed position the movable closure caps the post engagement portion.

10. The system of claim 8, wherein a living hinge connects the movable closure to the portion of the attachment body having the receiving opening therein.

11. The system of claim 1, further comprising a toilet seat connected to the pivot portion of the attachment body.

12. The system of claim 1, wherein the attachment body is unitarily formed of a single piece of molded plastic.

13. A method for attaching a toilet seat assembly having an attachment body and a post to a toilet fixture, the toilet seat assembly comprising a toilet seat hingedly coupled to a pivot portion of the attachment body, the method comprising:

extending an end of a rod portion of the post through a mounting hole of the toilet fixture while a post engagement portion of the post is disposed above a surface of the toilet fixture, a post head attached to the rod portion being positioned in a recess of the post engagement portion, the post engagement portion being distinct from the post head and from the rod portion, the post engagement portion comprising a barrel portion having a plurality of different diameters defining a contour of the post engagement portion;

inserting an elastomeric bushing into the mounting hole of the toilet fixture, the elastomeric bushing being distinct from the attachment body and having a top;

securing the rod portion of the post in the mounting hole of the toilet fixture;

guiding the post engagement portion of the post substantially in a direction along a receiving opening axis into a receiving opening of the attachment body while placing the toilet seat on top of the toilet fixture, the receiving opening axis being perpendicular to a pivot axis of the pivot portion and having a periphery having a first height;

laterally moving the toilet seat assembly with respect to the receiving opening axis until an attachment body engagement portion of a periphery of the receiving opening mates with the post engagement portion, the attachment body engagement portion having a contour that is complementary to and mating with the contour of the post engagement portion, the periphery of the receiving opening having a first height; and moving a closure of the attachment body from an open position to a closed position such that a latching tab of a tab portion of the closure contacts a bottom portion of a base portion of the attachment body to prevent disengagement of the attachment body engagement portion from the post engagement portion, the tab portion being separated from the post head by the post engagement portion and positioned between the pivot portion and the post engagement portion, the top of the elastomeric bushing being positioned below the bottom surface of the base portion, the movable closure being positioned above a covered portion of the attachment body located between the pivot portion and the post engagement portion with a curved projection of the tab portion that has a contour that is complementary to the contour of the post engagement portion, and the first height being greater than any height of the covered portion.

14. The method of claim 13, further comprising:

moving the closure of the attachment body from the closed position to the open position to enable disengagement of the attachment body engagement portion from the post engagement portion;

laterally moving the toilet seat assembly with respect to the receiving opening axis until the attachment body engagement portion disengages from the mating receiving opening; and lifting the toilet seat assembly to bring the post engagement portion out of the receiving opening.

15. The method of claim 13, wherein moving a closure of the attachment body from an open position to a closed position comprises moving the tab portion of the closure into a space within the receiving opening to prevent lateral movement of the post and the attachment body relative to one another.

16. The method of claim 15, wherein:

laterally moving the toilet seat assembly with respect to the receiving opening axis until an attachment body engagement portion of a periphery of the receiving opening mates with the post engagement portion comprises the post engagement portion moving from a first sub-region of the receiving opening to a sub-region of the receiving opening; and moving the closure from the open position to the closed position comprises moving the tab portion of the closure into a portion of the first sub-region vacated by the post engagement portion after having moved from the first sub-region to the second sub-region.

17. The method of claim 16, wherein moving the closure from an open position to a closed position comprises hingedly moving the closure from the open position to the closed position while the tab portion of the closure moves along an arcuate path into the portion of the first sub-region vacated by the post engagement portion.

18. The method of claim 13, wherein moving the closure from an open position to a closed position comprises hingedly moving the closure.

19. The method of claim 18, wherein moving the closure from an open position to a closed position further comprises capping the post engagement portion.

20. The method of claim 13, wherein the movable closure has a widest portion that is wider than any other portion of the attachment body beneath the movable closure in the closed position.

21. The method of claim 20, wherein, in the closed position, a forward portion of the movable closure is positioned (a) between the tab portion and the pivot portion and (b) above a portion of the attachment body from which the forward portion will be spaced apart.

22. The method of claim 13, wherein, in the closed position, a forward portion of the movable closure is positioned (a) between the tab portion and the pivot portion and (b) above a portion of the attachment body from which the forward portion will be spaced apart.

23. The system of claim 1, wherein the movable closure has a widest portion that is wider than any other portion of the attachment body that will be beneath the movable closure when the movable closure is in the closed position.

24. The system of claim 23, wherein, in the closed position, a forward portion of the movable closure will be positioned (a) between the tab portion and the pivot portion and (b) above a portion of the attachment body from which the forward portion will be spaced apart.

25. The system of claim 1, wherein, in the closed position, a forward portion of the movable closure will be positioned (a) between the tab portion and the pivot portion and (b) above a portion of the attachment body from which the forward portion will be spaced apart.

26. A system comprising:

a post having:

a post axis;

a rod portion extendable through a mounting hole of a toilet fixture;

a post head attached to the rod portion; and a post engagement portion distinct from the post head and from the rod portion and oriented radially to the post axis, the post engagement portion having:

a passageway in which a portion of the rod portion can be positioned;

a recess in communication with the passageway and in which the post head can be positioned; and a barrel portion having a plurality of different diameters defining a contour of the post engagement portion;

an attachment body unitarily formed of a single piece of molded plastic and having:

a pivot portion with a pivot axis;

a receiving opening with a receiving opening axis perpendicular to the pivot axis, a periphery of the receiving opening having a first height and an attachment body engagement portion oriented radially to the receiving opening axis and mateable with the post engagement portion from a lateral direction with respect to the receiving opening axis and the post axis when the post engagement portion is received in the receiving opening;

a receiving region of the receiving opening that has no lateral dimension smaller than a maximum radial dimension of the post engagement portion to enable receiving the post engagement portion in the receiving opening from an axial direction with respect to the receiving opening axis, the attachment body engagement portion having a contour that is complementary to the contour of the post engagement portion;

a base portion having a bottom surface, and a movable closure connected to the attachment body with a living hinge and the movable closure including:

a tab portion including a latching tab and a curved projection having a contour that is complementary to the contour of the post engagement portion;

wherein the movable closure is movable between a closed position preventing disengagement of the attachment body engagement portion and the post engagement portion and an open position enabling disengagement of the attachment body engagement portion from the post engagement portion, and the movable closure has a widest portion that is wider than any other portion of the attachment body that will be beneath the movable closure when the movable closure is in the closed position;

an elastomeric bushing distinct from the attachment body and having a top, the elastomeric bushing coupled to the post such that, when the post head is positioned in the recess of the post engagement portion, the top of the elastomeric bushing is positioned below the bottom surface of the base portion; and a toilet seat connected to the pivot portion of the attachment body;

wherein, in the closed position, the latching tab of the tab portion will contact the base portion to retain the movable closure in the closed position, and the tab portion will be separated from the post head by the post engagement portion and positioned between the pivot portion and the post engagement portion;

wherein, when the movable closure is in the closed position:

the movable closure is positioned above a covered portion of the attachment body located between the pivot portion and the post engagement portion, the first height being greater than any height of the covered portion, the covered portion is substantially below a concave bottom surface of the movable closure, and a forward portion of the movable closure will be positioned (a) between the tab portion and the pivot portion, and (b) above a portion of the attachment body from which the forward portion will be spaced apart;

wherein the post engagement portion occupies a first sub-region of the receiving region when the attachment body engagement portion is not mated with the post engagement portion, and the post engagement portion occupies a second sub-region when the attachment body engagement portion is mated with the post engagement portion, wherein the first sub-region and second sub-region overlap each other; and wherein a third sub-region of the receiving region is defined by the receiving region minus the second sub-region, and the tab portion of the movable closure is movable along an arcuate path into the third sub-region and is disposed within the third sub-region when the movable closure is in the closed position.

* * * * *